US005855198A

United States Patent [19]

Nakajima et al.

[11] Patent Number: 5,855,198

[45] Date of Patent: Jan. 5, 1999

[54] CANISTER SYSTEM

[75] Inventors: Takeaki Nakajima, Kaminokawa-machi; Shoichi Hokazono, Uchunomiya; Koichi Hidano, Utsunomiya; Kiyofumi Shida, Shioya-gun; Masaaki Horiuchi, Utsunomiya, all of Japan

[73] Assignee: Honda Giken Kogyo Kabushiki Kaisha, Tokyo, Japan

[21] Appl. No.: 851,249

[22] Filed: May 5, 1997

[30] Foreign Application Priority Data

May 7, 1996 [JP] Japan ..... 8-135675

[51] Int. Cl.[6] ..... F02M 37/04

[52] U.S. Cl. ..... 123/520; 123/519

[58] Field of Search ..... 123/519, 520, 123/521, 518, 516, 198 D

[56] References Cited

U.S. PATENT DOCUMENTS

| | | | |
|---|---|---|---|
| 4,727,955 | 3/1988 | Honda | 123/519 |
| 4,787,643 | 11/1988 | Shirata | 123/519 |
| 5,058,693 | 10/1991 | Murdock | 123/519 |
| 5,060,620 | 10/1991 | Oslapas | 123/519 |
| 5,111,900 | 5/1992 | Leiterman | 123/519 |
| 5,224,455 | 7/1993 | Ogasawara | 123/519 |
| 5,427,076 | 6/1995 | Kobayashi | 123/520 |
| 5,687,697 | 11/1997 | Ishikawa | 123/520 |

FOREIGN PATENT DOCUMENTS

| | | | |
|---|---|---|---|
| 4362244 | 12/1992 | Japan | 123/519 |

*Primary Examiner*—Carl S. Miller
*Attorney, Agent, or Firm*—Frishauf, Holtz, Goodman, Langer & Chick

[57] ABSTRACT

A canister system is installed in a vehicle having a body having a substantially closed space defined therein, and a subframe mounted on the body and having a substantially closed space defined therein. An air intake passage is connected to a canister for drawing and delivering fresh air into the canister, and an air exhaust passage is connected to the canister for exhausting air resulting from removal of evaporative fuel components from an evaporative fuel-air mixture by adsorption of the evaporative fuel components by the canister into the atmosphere. An open end of the air intake passage remote from the canister is formed in the body of the vehicle, and an open end of the air exhaust passage remote from the canister is formed in the subframe.

13 Claims, 4 Drawing Sheets

CANISTER SYSTEM

BACKGROUND OF THE INVENTION

1. Field of the Invention

The present invention relates to a canister system for use in vehicles or the like, and more particularly to improvements in or to the air intake/exhaust arrangement of a canister system.

2. Prior Art

FIG. 1 schematically shows the air intake/exhaust arrangement of a conventional canister system. Connected to a canister 114 are an air intake passage 121 through which fresh air is drawn into the canister 114 and an air exhaust passage 125 through which air is exhausted from the canister 114 after removal of evaporative fuel components from an evaporative fuel-air mixture by adsorption of the evaporative fuel components by the canister 114. The air intake passage 121 has an air-inlet open end 121*a* remote from the canister 114, which is formed in a side frame 101 of a body of a vehicle, not shown, and a one-way valve 123 arranged thereacross. The air exhaust passage 125 also has a one-way valve 127 arranged thereacross. The air intake passage 121 and the air exhaust passage 125 are joined together at sides of the respective one-way valves 123 and 127 closer to the canister 114. The air exhaust passage 125 has an air-outlet open end 125*a* arranged at a lower portion of the vehicle body in opposed relation to a mudguard cover 130 such that the air-outlet open end 125*a* will not be clogged with mud or the like.

With the above arrangement, evaporative fuel generated in a fuel tank, not shown, at refueling is delivered to the canister 114 to be adsorbed thereby, and air resulting from the removal of evaporative fuel components from the evaporative fuel-air mixture is delivered from the canister 114 into the air exhaust passage 125 and discharged into the atmosphere through its air-outlet open end 125*a*. On the other hand, when evaporative fuel is purged from the canister 114 to an engine, not shown, fresh air is drawn through the air-inlet open end 121*a* formed in the side frame 101, into the air intake passage 121 and delivered to the canister 114.

According to the air intake/exhaust arrangement of the conventional canister system, however, a special part such as the mudguard cover 130 has to be employed. Further, although the mudguard cover 130 can prevent clogging of the air-outlet open end 125*a* of the air exhaust passage 125 with mud or the like, it cannot prevent introduction of water into the open end 125*a*. If water introduced into the open end 125*a* is frozen, it causes a decrease in the opening area of the open end 125*a*, and in the worst case it can clog the open end 125*a*.

In a canister system where evaporative fuel generated in a fuel tank at refueling is not adsorbed by a canister, when the ambient temperature is so low that water is frozen, the amount of evaporative fuel generated in the fuel tank is very small, causing almost no problem even if the opening area of the air-outlet open end decreases with water freeze-up. In contrast, in the air intake/exhaust arrangement of the conventional canister system as illustrated where evaporative fuel generated in a fuel tank at refueling is delivered to the canister to be adsorbed thereby, if the opening area of the air-outlet open end 125*a* decreases, the flow resistance of the open end 125*a* increases such that refueling cannot be carried out in the worst case.

SUMMARY OF THE INVENTION

It is an object of the invention to provide a canister system having an air intake/exhaust arrangement which is free from a decrease in the opening area of an air-outlet open end of an air exhaust passage thereof caused by freeze-up of water introduced into the open end.

It is a further object of the invention to provide a canister system having an air intake/exhaust arrangement which has a reduced number of parts, thereby having improved mountability and a reduced manufacturing cost.

To attain the above objects, the present invention provides a canister system for use in a vehicle having a body having a substantially closed space defined therein, and a subframe mounted on the body and having a substantially closed space defined therein, the canister system comprising:

a canister;

an air intake passage connected to the canister, for drawing and delivering fresh air to the canister, the air intake passage having an open end remote from the canister; and an air exhaust passage connected to the canister, for exhausting air resulting from removal of evaporative fuel components from an evaporative fuel-air mixture by adsorption of the evaporative fuel components by the canister, into the atmosphere, the air exhaust passage having an open end remote from the canister;

wherein the open end of the air intake passage remote from the canister is formed in the body of the vehicle, and the open end of the air exhaust passage remote from the canister is formed in the subframe of the vehicle.

Specifically, the subframe supports a suspension of the vehicle.

Preferably, the open end of the air intake passage remote from the canister is formed in one of side frames of the body of the vehicle.

Preferably, the side frames are located upward of the subframe.

In a preferred embodiment of the invention, the canister system includes a first one-way valve provided in the air intake passage, and a second one-way valve provided in the air exhaust passage.

The invention can be advantageously applied to a canister system which includes a charging passage extending between a fuel tank installed in the vehicle and the canister, for allowing evaporative fuel generated in the fuel tank at refueling to be delivered through the charging passage to the canister to be adsorbed thereby.

The above and other objects, features, and advantages of the invention will be more apparent from the following detailed description taken in conjunction with the accompanying drawings.

DETAILED DESCRIPTION OF THE PREFERRED EMBODIMENT

The invention will now be described in detail with reference to the drawings showing an embodiment thereof.

Figure 1:
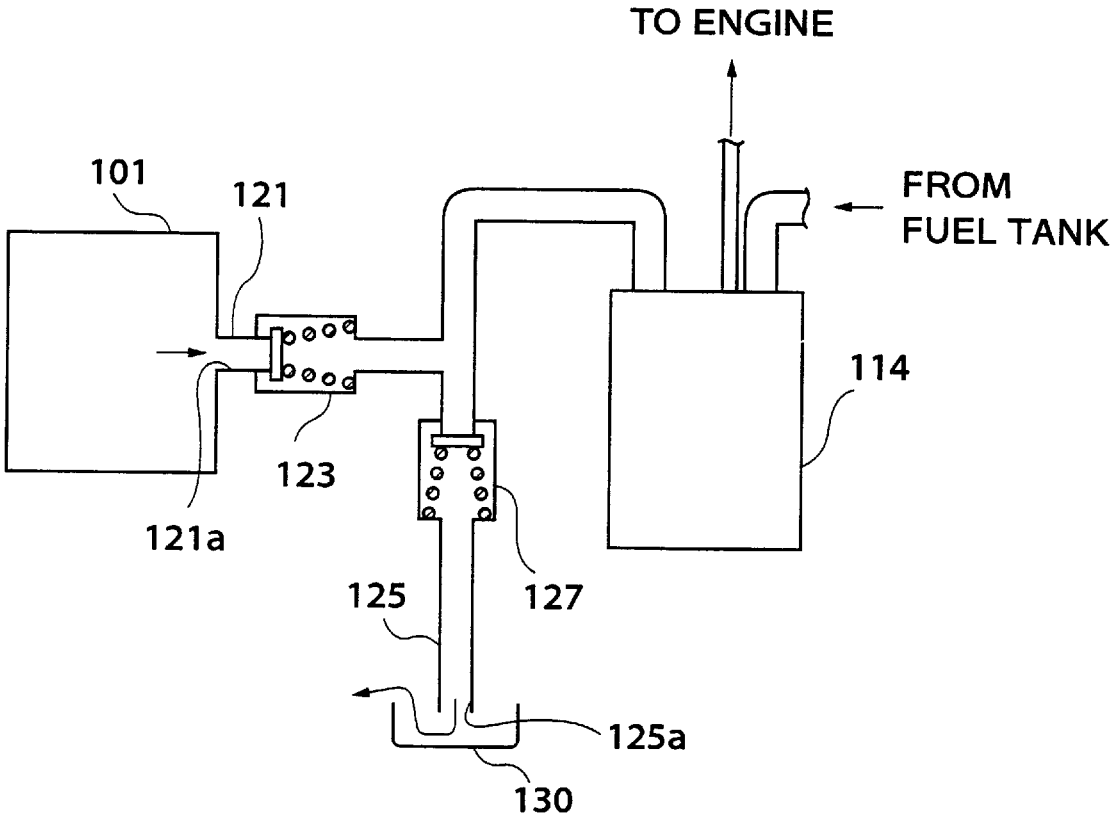
FIG.1 PRIOR ART
FIG. 1 shows a schematic view showing the air intake/exhaust arrangement of a conventional canister system.
Figure 2:
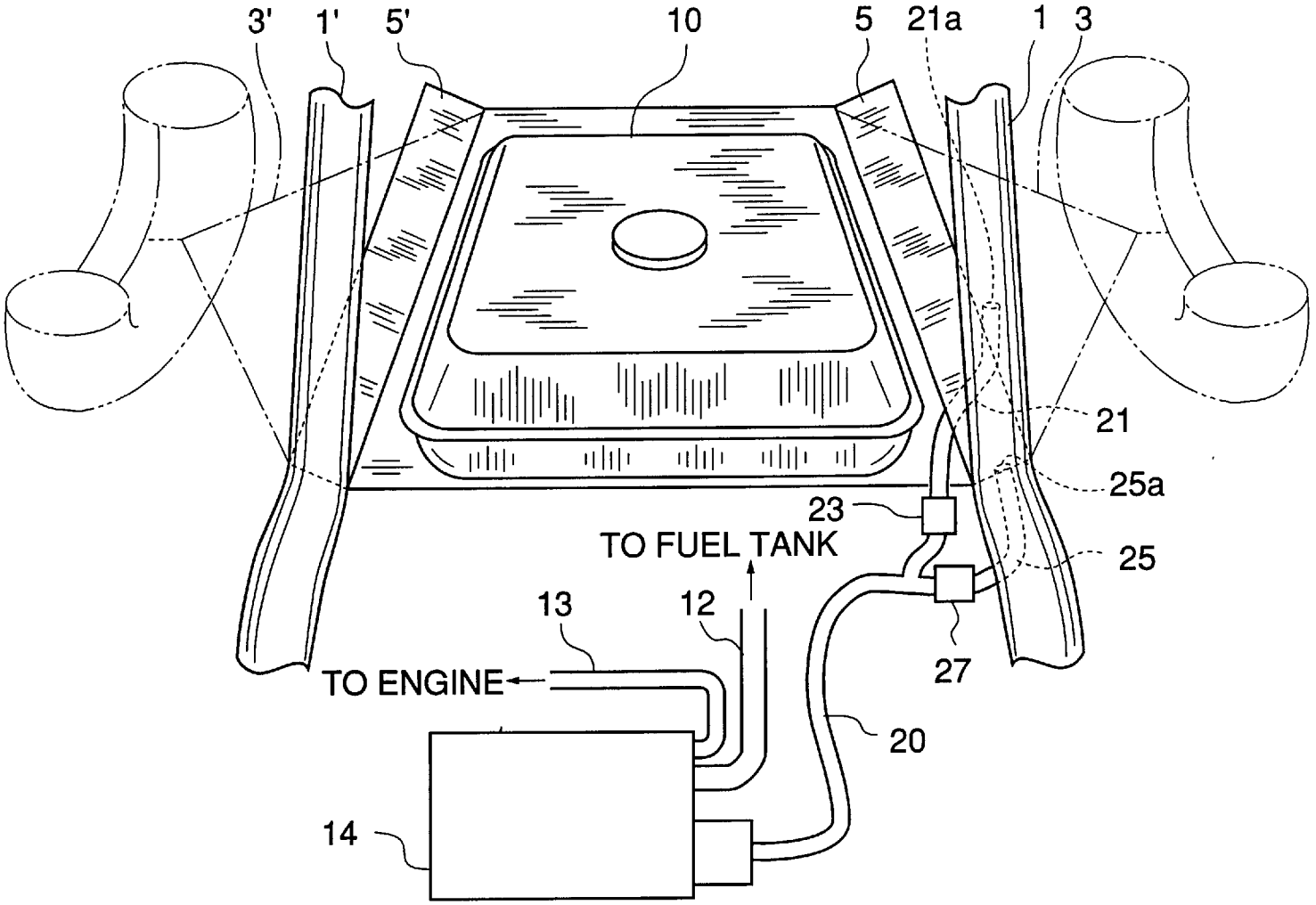
FIG. 2 is a schematic view showing the air intake/exhaust arrangement of a canister system according to an embodiment of the invention, which is installed in an automotive vehicle, with a fuel tank and its neighboring parts viewed from an upward location thereof.
Figure 3:
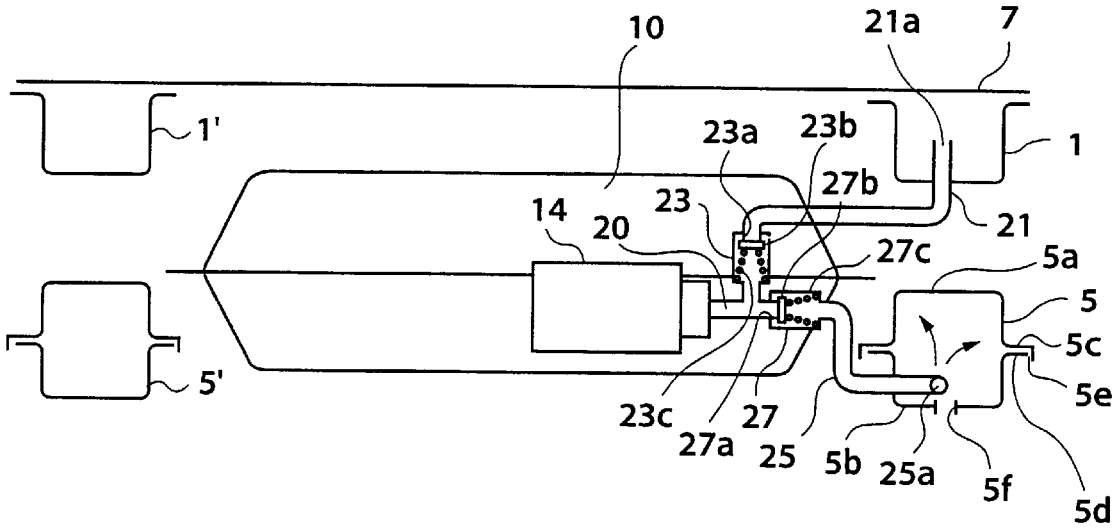
FIG. 3 is a schematic view showing the air intake/exhaust arrangement of the canister system of FIG. 2 as viewed from a front side of a body of the vehicle.

FIG. 2 schematically shows the air intake/exhaust arrangement of a canister system according to an embodiment of the invention, which is installed in an automotive vehicle, and FIG. 3 schematically shows the air intake/exhaust arrangement of the canister system of FIG. 2 as viewed from a front side of a body of the vehicle.

In the figures, reference numerals 1 and 1' designate left and right side frames which form parts of the body of the automotive vehicle, not shown, and are arranged below a vehicle compartment, not shown. Left and right subframe-forming members 5 and 5' which form a subframe are mounted, respectively, on the side frames 1 and 1' at lower side surfaces thereof. Rear suspensions 3, 3' are supported from the subframe-forming members 5, 5'. The subframe facilitates mounting of the suspension 3, a differential, etc. as well as reinforces the body of the vehicle and reduces vibration thereof.

As shown in FIG. 3, the vehicle body has a floor member 7, below which is arranged a fuel tank 10. A canister 14 which accommodates activated charcoal as an adsorbent for evaporative fuel is arranged in front of the fuel tank 10. A charging passage 12 extends between the fuel tank 10 and the canister 14. A purging passage 13 extends between the canister 14 and an intake pipe, not shown, of an internal combustion engine, not shown.

At refueling, evaporative fuel generated in the fuel tank 10 passes the charging passage 12 and is adsorbed by the canister 14. On the other hand, during operation of the engine, evaporative fuel is drawn from the canister 14 to the engine through the purging passage 13 and the intake pipe due to vacuum generated in the intake pipe.

Connected to the canister 14 is an air intake/exhaust passage 20 to which is connected an air exhaust passage 25 with a one-way valve 27 arranged thereacross. Further provided is an air intake passage 21 with a one-way valve 23 arranged thereacross. The air exhaust passage 25 and the air intake passage 21 are joined together at sides of their respective one-way valves 27, 23 closer to the canister 14 and connected to the air intake/exhaust passage 20. The air intake passage 21 has an air-inlet open end 21*a* thereof remote from the canister 14 formed in a peripheral wall of the left side frame 1.

The side frame 1 is mounted on an underside surface of the floor member 7 and has a generally U-shaped cross section defining a generally U-shaped almost closed space therein. Since the side frame 1 is located above the left subframe-forming member 5, water, mud, etc. are not likely to enter the side frame 1.

On the other hand, the air exhaust passage 25 has an air-outlet open end 25*a* thereof remote from the canister 14 formed in a peripheral wall of the left subframe-forming member 5. The subframe-forming member 5 is formed of an upper frame half 5*a* and a lower frame half 5*b* which have respective flanges 5*c* and 5*d* abutting against each other with a small gap 5*e* defined therebetween, thereby providing a generally rectangular cross section defining a generally rectangular almost closed space therein. The lower frame half 5*b* has a bottom wall thereof formed therein with a drain hole 5*f* for escaping water. Thus, the subframe-forming member 5 has an almost closed space defined therein so that water, mud, etc. cannot easily enter the subframe-forming member 5.

Figure 4A:
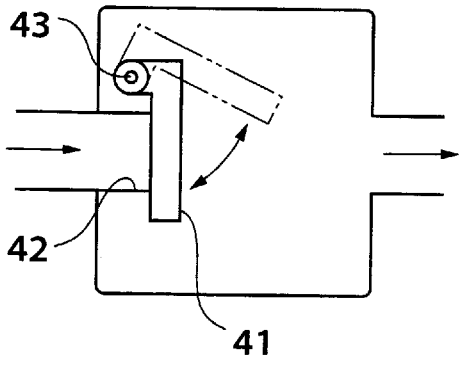
FIG. 4A is a schematic sectional view showing another type of one-way valve than a one-way valve appearing in FIG. 3.
Figure 4B:
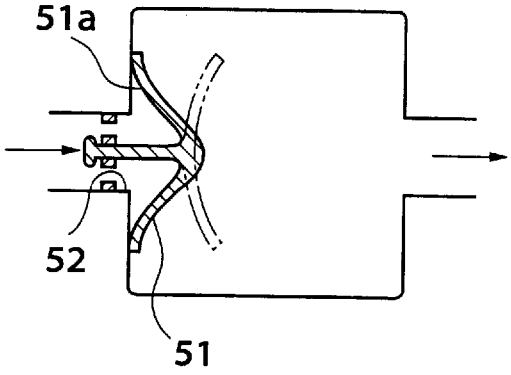
FIG. 4B is a schematic sectional view showing still another type of one-way valve than the one-way valve appearing in FIG. 3.

The one-way valves 23 and 27 are each formed by a check valve comprised of a valve bore 23*a*, 27*a* formed in the respective passage 21, 25, a valve element 23*b*, 27*b* for opening or closing the valve bore 23*a*, 27*a*, and a spring 23*c*, 27*c* for biasing the valve element 23*b*, 27*b* toward the valve bore 23*a*, 27*a*. The one-way valves 23 and 27 may be another type valve than the check valve, such as a flap valve as shown in FIG. 4A and a mushroom valve as shown in FIG. 4B. The flap valve in FIG. 4A has a generally L-shaped valve element 41 which is pivotally mounted on a shaft 43 and operates such that when the pressure of inlet-side fluid is not higher than the pressure of outlet-side fluid by a predetermined amount or more, the valve element 41 is in a position closing a valve bore 42 due to its own weight, while when the former exceeds the latter by the predetermined amount or more, the valve element 41 opens the valve bore 42. The mushroom valve in FIG. 4B has a valve element 51 with a cap-shaped head 51*a* and operates such that when the pressure of inlet-side fluid is not higher than the pressure of outlet-side fluid by a predetermined amount or more, the valve element 51 is in a position closing a valve bore 52 due to its own elasticity, while when the former exceeds the latter by the predetermined amount or more, the head 51*a* of the valve element 51 warps back into a position where the valve bore 52 is open.

With the above air intake/exhaust arrangement, during refueling evaporative fuel generated in the fuel tank 10 is adsorbed by the canister 14 and air resulting from removal of evaporative fuel components from the evaporative fuel-air mixture by adsorption of the evaporative fuel components by the canister 14 is exhausted from the canister 14 through the air intake/exhaust passage 20, and then through the air exhaust passage 25 to be emitted into the atmosphere from the air-outlet open end 25*a* of the passage 25 formed in the subframe-forming member 5. On the other hand, during purging of evaporative fuel from the canister 14 to the engine fresh air is drawn from the air-inlet open end 21*a* of the air intake passage 21 formed in the side frame 1 and then delivered to the canister 14 through the passage 21.

Since in the present embodiment the air-outlet open end 25*a* of the air exhaust passage 25 is formed in the subframe-forming member 5, entry of water, mud, etc. into the open end 25*a* can be prevented. As a result, the opening area of the air-outlet open end 25*a* is prevented from decreasing due to freeze-up of water, etc. in the open end 25*a*, and in the worst case the open end 25*a* is clogged with ice or frozen mud, which impedes refueling. Further, no special part such as a mudguard cover need to be employed, thus curtailing the number of component parts used and hence reducing the manufacturing cost as well as improving the mountability.

Further, the subframe-forming member 5 formed with the air-outlet open end 25*a* of the air exhaust passage 25 is usually formed of a member separate from the vehicle body, and therefore air emitted from the air exhaust passage 25 does not enter the vehicle compartment, whereby no smell is generated in the vehicle compartment.

What is claimed is:

1. A canister system for use in a vehicle having a body and a subframe mounted on said body, said subframe having a substantially closed space defined therein which is separated from a substantially closed space defined in said body, the canister system comprising:

a canister;

an air intake passage connected to said canister for drawing and delivering fresh air to said canister, said air intake passage having an open end remote from said canister; and an air exhaust passage connected to said canister for atmospherically exhausting air resulting from removal of evaporative fuel components from an evaporative fuel-air mixture by adsorption of said evaporative fuel components by said canister, said air exhaust passage having an open end remote from said canister;

wherein said open end of said air intake passage remote from said canister is formed in said body of said vehicle, and said open end of said air exhaust passage remote from said canister extends into the substantially closed space defined in said subframe of said vehicle.

2. A canister system as claimed in claim 1, wherein said vehicle comprises a suspension and said subframe supports said suspension.

3. A canister system as claimed in claim 1, wherein said body of said vehicle comprises side frames and said open end of said air intake passage remote from said canister is formed in one of said side frames.

4. A canister system as claimed in claim 1, wherein said side frames are located upward of said subframe.

5. A canister system as claimed in claim 1, further comprising a first one-way valve provided in said air intake passage, and a second one-way valve provided in said air exhaust passage.

6. A canister system as claimed in claim 1, wherein said vehicle comprises a fuel tank and said canister system includes a charging passage extending between said fuel tank and said canister for enabling evaporative fuel generated in said fuel tank at refueling to be delivered through said charging passage to said canister to be adsorbed thereby.

7. A canister system as claimed in claim 5, wherein said first and second one-way valves are check valves.

8. A canister system as claimed in claim 7, wherein said check valves each comprise a valve bore, a valve element for closing the valve bore, and a spring for biasing the valve element toward the valve bore.

9. A canister system as claimed in claim 5, wherein said first and second one-way valves are flap valves.

10. A canister system as claimed in claim 9, wherein said flap valves each comprise a valve bore and a generally L-shaped valve element which is pivotally mounted on a shaft so that the valve element is in a position for closing the valve bore due to its own weight.

11. A canister system as claimed in claim 5, wherein said first and the second one-way valves are mushroom valves.

12. A canister system as claimed in claim 11, wherein said mushroom valves each comprise a valve bore and a valve element with a cap-shaped head for closing the valve bore due to its own elasticity.

13. A canister system for use in a vehicle having a body and a subframe mounted on said body, said body having side frames with a substantially closed space defined therein and said subframe having a substantially closed space defined therein which is separated from the substantially closed space defined in said body, the canister system comprising:

a canister;

an air intake passage connected to said canister for drawing and delivering fresh air to said canister, said air intake passage having an open end remote from said canister; and an air exhaust passage connected to said canister for atmospherically exhausting air resulting from removal of evaporative fuel components from an evaporative fuel-air mixture by adsorption of said evaporative fuel components by said canister, said air exhaust passage having an open end remote from said canister;

wherein said open end of said air intake passage remote from said canister is formed in one of said side frames and extends into the substantially closed space defined therein, and said open end of said air exhaust passage remote from said canister extends into the substantially closed space defined in said subframe of said vehicle.

* * * * *

UNITED STATES PATENT AND TRADEMARK OFFICE

CERTIFICATE OF CORRECTION

PATENT NO. : 5,855,198

DATED : January 5, 1999

INVENTOR(S) : Takeaki NAKAJIMA et al.

It is certified that error appears in the above-identified patent and that said Letters Patent is hereby corrected as shown below:

Item [75] Inventors, line 3, change "Uchunomiya"

to --Utsunomiya--.

Signed and Sealed this

Twentieth Day of June, 2000

*Attest:*

Q. TODD DICKINSON

*Attesting Officer*

*Director of Patents and Trademarks*